US012781309B2

(12) United States Patent
Tian et al.

(10) Patent No.: US 12,781,309 B2
(45) Date of Patent: Nov. 3, 2026

(54) METHOD FOR SMELTING MAGNESIUM FROM DOLOMITE BY VACUUM CARBOTHERMAL REDUCTION

(71) Applicant: KUNMING UNIVERSITY OF SCIENCE AND TECHNOLOGY, Kunming (CN)

(72) Inventors: Yang Tian, Kunming (CN); Tingzhuang Ma, Kunming (CN); Bin Yang, Kunming (CN); Baoqiang Xu, Kunming (CN); Wenlong Jiang, Kunming (CN); Yifu Li, Kunming (CN); Fei Wang, Kunming (CN); Yong Deng, Kunming (CN); Shuji Wu, Kunming (CN); Haosong Yu, Kunming (CN); Lipeng Wang, Kunming (CN); Dong Liang, Kunming (CN)

(73) Assignee: KUNMING UNIVERSITY OF SCIENCE AND TECHNOLOGY, Kunming (CN)

( * ) Notice: Subject to any disclaimer, the term of this patent is extended or adjusted under 35 U.S.C. 154(b) by 388 days.

(21) Appl. No.: 18/681,412

(22) PCT Filed: Jun. 20, 2023

(86) PCT No.: PCT/CN2023/101205

§ 371 (c)(1),
(2) Date: Feb. 5, 2024

(87) PCT Pub. No.: WO2024/229934

PCT Pub. Date: Nov. 14, 2024

(65) Prior Publication Data

US 2026/0110056 A1 Apr. 23, 2026

(30) Foreign Application Priority Data

May 10, 2023 (CN) ..... 202310524049.6

(51) Int. Cl.
*C22B 26/22* (2006.01)
*C22B 1/24* (2006.01)
(Continued)

(52) U.S. Cl.
CPC ..... *C22B 26/22* (2013.01); *C22B 1/2406* (2013.01); *C22B 5/10* (2013.01); *C22B 5/16* (2013.01)

(58) Field of Classification Search
None
See application file for complete search history.

(56) References Cited

U.S. PATENT DOCUMENTS

2017/0183760 A1* 6/2017 Zhang ..... C22B 5/16

FOREIGN PATENT DOCUMENTS

CN 1769505 A * 5/2006
CN 101397609 A * 4/2009
(Continued)

*Primary Examiner* — Seth Dumbris
(74) *Attorney, Agent, or Firm* — Knobbe, Martens, Olson & Bear, LLP

(57) ABSTRACT

Disclosed is a method for smelting magnesium from dolomite by vacuum carbothermal reduction. The method includes: pressing a mixed powder of dolomite and coking coal to obtain a block; and heating the block directly to obtain a heated block, subjecting the heated block to a carbothermal reduction reaction in vacuum to obtain a reduced vapor, and condensing the reduced vapor to obtain crystalline magnesium, wherein the heating is conducted at a heating rate of ≤12 K/min; and the carbothermal reduction reaction is held at a temperature of ≥1,400 K for ≤2 h.

15 Claims, 5 Drawing Sheets

(51) Int. Cl.
*C22B 5/10* (2006.01)
*C22B 5/16* (2006.01)

(56) References Cited

FOREIGN PATENT DOCUMENTS

| | | | | | |
|---|---|---|---|---|---|
| CN | 102277506 | A | * | 12/2011 | |
| CN | 107917618 | A | * | 4/2018 | ..... F27B 14/04 |
| WO | WO-2009020890 | A1 | * | 2/2009 | ..... C22B 61/00 |

* cited by examiner

METHOD FOR SMELTING MAGNESIUM FROM DOLOMITE BY VACUUM CARBOTHERMAL REDUCTION

CROSS REFERENCE TO RELATED APPLICATION

This patent application is a US national stage application of International Patent Application No. PCT/CN2023/101205, filed on Jun. 20, 2023, which_claims priority to the Chinese Patent Application No. CN202310524049.6, filed with the China National Intellectual Property Administration (CNIPA) on May 10, 2023, and entitled "METHOD FOR SMELTING MAGNESIUM FROM DOLOMITE BY VACUUM CARBOTHERMAL REDUCTION". The disclosure of each of these applications is incorporated herein by reference in its entirety.

TECHNICAL FIELD

The present disclosure belongs to the technical field of vacuum smelting of metal magnesium, and specifically relates to a method for smelting magnesium from dolomite by vacuum carbothermal reduction.

BACKGROUND

Magnesium-based material is the lightest engineering metal material in industrial applications, with a density being only 64% of aluminum and 25% of zinc, and is expected to replace steel and aluminum material as a new generation of structural material. It is known as "green engineering materials for the 21st century" and "revolutionary medical metal material". In the past five years, the average annual growth rate of global primary magnesium demand has exceeded 10%, and raw magnesium has reached 1000,000 tons in 2022 worldwide. As the upstream of the magnesium industry chain, the development level of magnesium smelting directly affects the development of the whole industry and has excellent development prospects.

At present, more than 80% of the primary magnesium in China is produced by the silico-thermal method (Pidgeon method). The Pidgeon method has been developed for more than 80 years, and the technology has been relatively mature. However, the update and iteration of the equipment has always been unable to solve the problems such as high energy consumption, high resource consumption, high raw material requirements, and large $CO_2$ emissions produced during the magnesium smelting by the Pidgeon method. In particular, the reducing agent used, ferrosilicon, is not only expensive, but also the preparation method causes serious environmental pollution, which seriously violates the 'green and low-carbon' development strategy.

Chinese patent CN1769505A discloses a method for extracting magnesium metal from magnesia ore by coal-thermic reduction in vacuum. Magnesium oxide or its mineral dolomite are used as raw materials. The raw materials and a reducing agent, coal, are crushed to 1-3 mm and compounded and mixed to be uniform in a C:MgO ratio of (2-3.5):1, obtaining a mixture. One or two of the additives, $CaF_2$ and NaF accounting for 5~10 wt % of the mixture are added to the mixture, mixed to be uniform again, and pressed into pellets with a diameter of 10-40 mm, then the pellets are added into a vacuum furnace with a vacuum degree controlled at 5-45 Pa. Firstly, the pellets are coked at a temperature of 500-800° C. for 30-60 min, and then raised to 1,300-1,600° C. for reduction reaction for 45-60 min.

However, the above method not only requires the use of $CaF_2$ or NaF as an additive, but also requires the raw materials to be coked at a higher temperature. Through the coking treatment, the reducing agent, coal, is coated on the surface of magnesium oxide or its mineral dolomite raw material, and bonded into an integrated structure, then the temperature is raised again for the reduction reaction, so as to achieve the full reaction of the reducing agent, coal, with magnesium oxide or its mineral dolomite raw material. However, the above method still has the problems of high heat consumption and high cost.

SUMMARY

An object of the present disclosure is to provide a method for smelting magnesium from dolomite by vacuum carbothermal reduction. The method according to the present disclosure does not require the addition of auxiliary materials and thus reduces production costs, and has low heat consumption and reduced energy consumption, and also enables the full utilization of $CO_2$ to be realized and environmental pollution to be reduced.

To achieve the above object, the present disclosure provides the following technical solutions:

The present disclosure provides a method for smelting magnesium from dolomite by vacuum carbothermal reduction, including:

pressing a mixed powder of dolomite and coking coal to obtain a block; and heating the block directly to obtain a heated block, subjecting the heated block to a carbothermal reduction reaction in vacuum to obtain a reduced vapor, and condensing the reduced vapor to obtain crystalline magnesium, wherein the heating is conducted at a heating rate of ≤12 K/min; and the carbothermal reduction reaction is held at a temperature of ≥1,400 K for ≤2 h.

In some embodiments, the heating is conducted at a heating rate of 8-12 K/min.

In some embodiments, the carbothermal reduction reaction is held at a temperature of 1,400-1,600 K for 1-2 h.

In some embodiments, the pressing is conducted at a pressure of 6-16 MPa.

In some embodiments, in the mixed powder of dolomite and coking coal, a molar ratio of the coking coal in terms of C content to the dolomite in terms of a $CaMg(CO_3)_2$ content is 2:1.

In some embodiments, the mixed powder of dolomite and coking coal has a particle size of ≤8.5 μm.

In some embodiments, the carbothermal reduction reaction is performed at a vacuum degree of 50-150 Pa.

In some embodiments, the condensing is conducted at a temperature of 623-760 K.

In some embodiments, the dolomite includes the following chemical compositions: 19.35 wt % of MgO, 27.48 wt % of CaO, 3.69 wt % of Fe, less than 0.005 wt % of Cu, 1.14 wt % of $SiO_2$, and 1.46 wt % of $Al_2O_3$.

In some embodiments, the coking coal has a moisture content of <0.2%, an ash content of 26.21%, a volatile matter content of 10.17%, and a fixed carbon content of ≥63.42 wt %.

The present disclosure provides a method for smelting magnesium from dolomite by vacuum carbothermal reduction, including: pressing a mixed powder of dolomite and coking coal to obtain a block; and heating the block directly, subjecting the heated block to a carbothermal reduction reaction in vacuum to obtain a reduced vapor, and condensing the reduced vapor to obtain crystalline magnesium, wherein the heating is conducted at a heating rate of ≤12 K/min; and the carbothermal reduction reaction is held at a temperature of ≥1,400 K for ≤2 h. The method provided by the present disclosure does not require the addition of auxiliary materials in the raw materials, which can effectively reduce the production cost. Meanwhile, the block obtained by dolomite and coking coal can directly undergo the carbothermal reduction reaction by controlling the heating rate at ≤12 K/min without temperature holding and coking, thus effectively reducing energy consumption. Finally, the thermal decomposition and carbothermal reduction of dolomite are completed in the same vacuum environment, which shortens the process for extracting magnesium from dolomite, reduces energy consumption, realizes the full utilization of $CO_2$, and reduces environmental pollution. The results of examples show that the crystalline magnesium obtained by the method provided by the present disclosure has a purity of 83.62-91.20%.

DETAILED DESCRIPTION OF THE EMBODIMENTS

Figure 1:
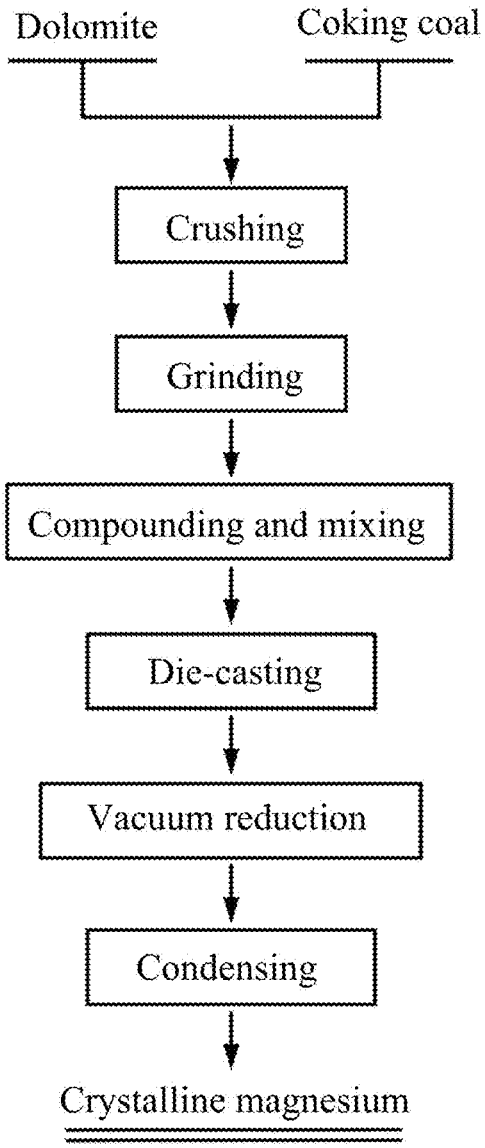
FIG. 1 shows a flowchart of an embodiment of the present disclosure.

The present disclosure provides a method for smelting magnesium from dolomite by vacuum carbothermal reduction, including the following steps:

pressing a mixed powder of dolomite and coking coal to obtain a block; and heating the block directly to obtain a heated block, subjecting the heated block to a carbothermal reduction reaction in vacuum to obtain a reduced vapor, and condensing the reduced vapor to obtain crystalline magnesium, wherein the heating is conducted at a heating rate of ≤12 K/min; and the carbothermal reduction reaction is held at a temperature of ≥1,400 K for ≤2 h.

In the present disclosure, unless otherwise specified, all the raw materials/components for preparation are commercially available products well known to those skilled in the art.

In the present disclosure, a mixed powder of dolomite and coking coal is pressed to obtain a block.

In some embodiments of the present disclosure, in the mixed powder of dolomite and coking coal, a molar ratio of coking coal in terms of $CaMg(CO_3)_2$ content to dolomite in terms of C content is 2:1. In the present disclosure, the coking coal is used as a reducing agent, and the dolomite is reduced to crystalline magnesium by carbothermal reaction in vacuum.

In some embodiments of the present disclosure, the mixed powder of dolomite and coking coal has a particle size of ≤8.5 μm. In some embodiments of the present disclosure, the mixed powder of dolomite and coking coal has a mesh number of 250 meshes or 300 meshes. In some embodiments of the present disclosure, the mixed powder of dolomite and coking coal has a particle size of ≤8.5 μm, which can increase the contact area of the dolomite and the coking coal in the mixed powder, thereby increasing the contact area of solid-solid reactants during the carbothermal reduction reaction and improving the efficiency of carbothermal reduction.

In some embodiments of the present disclosure, the mixed powder of dolomite and coking coal is prepared by a process including the following step:

mixing the dolomite and the coking coal to obtain a mixture, and subjecting the mixture to crushing and grinding in sequence to obtain the mixed powder of dolomite and coking coal.

In some embodiments of the present disclosure, the dolomite includes the following chemical compositions: 19.35 wt % of MgO, 27.48 wt % of CaO, 3.69 wt % of Fe, less than 0.005 wt % of Cu, 1.14 wt % of $SiO_2$, and 1.46 wt % of $Al_2O_3$.

In some embodiments of the present disclosure, the coking coal has a moisture content of <0.2%, an ash content of 26.21%, a volatile matter content of 10.17%, and a fixed carbon content of ≥63.42 wt %.

There is no special requirements for the specific implementation process of the crushing and grinding.

In some embodiments of the present disclosure, the pressing is conducted at a pressure of 6-16 MPa, and preferably 8-15 MPa.

In some embodiments of the present disclosure, the block is a bulk body.

In some embodiments of the present disclosure, the pressing is set at a pressure of 6-16 MPa to ensure that the dolomite particles and coking coal particles in the resulting block are in close contact, and to increase the mass transfer efficiency of the solid-solid phase reaction during the carbothermal reduction in vacuum, so that the reduction reaction is more sufficient.

In the present disclosure, after the block is obtained, the block is directly heated to obtain a heated block, the heated block is subjected to a carbothermal reduction reaction in vacuum to obtain a reduced vapor, the reduced vapor is condensed to obtain crystalline magnesium; the heating is conducted at a heating rate of ≤12 K/min; and the carbothermal reduction reaction is held at a temperature of ≥1,400 K for ≤2 h.

In some embodiments of the present disclosure, the carbothermal reduction reaction is conducted in a vacuum furnace; the vacuum furnace is divided into a reaction chamber and a condensation chamber; the condensation chamber is arranged above the reaction chamber and connected with the reaction chamber by a connecting pipe. The block is subjected to the carbothermal vacuum reduction reaction in the reaction chamber of the vacuum furnace, and the reduced vapor is condensed in the condensation chamber through the connecting pipe to obtain the crystalline magnesium.

In some embodiments of the present disclosure, before the heating, the vacuum furnace is flushed with nitrogen, and then the block is placed in the vacuum furnace; a circulating water cooling system, a control system and a vacuum system are opened; and the vacuum furnace is vacuumized to a vacuum condition by using the vacuum system.

In some embodiments of the present disclosure, the carbothermal reduction reaction is performed at a vacuum degree of 50-150 Pa, and preferably 60-140 Pa.

In some embodiments of the present disclosure, the heating is conducted at a heating rate of 8-12 K/min, and preferably 9-11 K/min.

In some embodiments of the present disclosure, the carbothermal reduction reaction is held at a temperature of 1,400-1,600 K, and the holding is conducted for 1-2 h.

In the method provided by the present disclosure, the carbothermal reduction reaction is conducted by directly and continuously heating up to the temperature of carbothermal reduction. In some embodiments of the present disclosure, by adjusting the heating rate to 8-12 K/min, the dolomite and coke in the block can be bonded together during the heating process, so that there is no need to carry out temperature holding and coking before the carbothermal reduction reaction. This technique not only simplifies the smelting steps, but also reduces the energy consumption.

In some embodiments of the present disclosure, the condensing is conducted at a temperature of 623-760 K, and preferably 630-750 K.

In some embodiments of the present disclosure, after the temperature holding of the carbothermal reduction reaction is completed, a vacuum system is closed after the temperature in the vacuum furnace has dropped to normal temperature, a vent valve is opened to restore the pressure in the furnace to normal pressure, and a circulating water cooling system and a control system are closed.

In the present disclosure, crystalline magnesium is in a form of a needle strip.

In some embodiments of the present disclosure, the resulting crystalline magnesium is analyzed by chemical analysis methods using an X-ray diffractometer (XRD), a scanning electron microscope (SEM) and an energy dispersive spectrometer (EDS). Among them, XRD is used to analyze the phases of residues (slag of carbothermal reduction reaction) and condensates (crystalline magnesium), SEM is used to characterize the structural characteristics of the residues and condensates, and EDS is used to characterize the chemical composition of the condensates.

To further illustrate the present disclosure, the technical solutions provided by the present disclosure will be described in detail below with reference to the examples, but they should not be understood as limiting the scope of the present disclosure.

Example 1

According to the flowchart shown in FIG. 1: dolomite (MgO 19.35 wt %, CaO 27.48 wt %, Fe 3.69 wt %, Cu <0.005 wt %, $SiO_2$ 1.14 wt %, and $Al_2O_3$ 1.46 wt %) and coking coal were crushed and ground to 300 meshes. The dolomite was calculated by a $CaMg(CO_3)_2$ content, the coking coal was calculated by a C content, and the dolomite and the coking coal were compounded at a C:$CaMg(CO_3)_2$ molar ratio of 2:1, obtaining a mixed powder. After mixing well, the mixed powder was die cast at a pressure of 8 MPa, forming a bulk material. A vacuum reduction furnace was flushed with argon, and the bulk material was placed in the vacuum reduction furnace. A circulating water cooling system, control system and vacuum system were opened. A heating rate of 10 K/min was set, and a vacuum degree was controlled at a range of 30-50 Pa. When the temperature was raised to 1,500±100 K, the reduction reaction was conducted for 1 h, obtaining crystalline magnesium, with a purity of 83.62%. A weight loss rate of the raw materials was 81.2% (the weight loss rate referred to a percentage of the reducing slag and raw materials obtained after the reduction reaction).

Example 2

According to the flowchart shown in FIG. 1: dolomite (MgO 19.35 wt %, CaO 27.48 wt %, Fe 3.69 wt %, Cu <0.005 wt %, $SiO_2$ 1.14 wt %, and $Al_2O_3$ 1.46 wt %) and coking coal were crushed and ground to 250 meshes. The dolomite was calculated by a $CaMg(CO_3)_2$ content, the coking coal was calculated by a C content, and the dolomite and the coking coal were compounded at a C:$CaMg(CO_3)_2$ molar ratio of 2, obtaining a mixed powder. After mixing well, the mixed powder was die cast at a pressure of 8 MPa, forming a bulk material. A vacuum reduction furnace was flushed with argon, and the bulk material was placed in the vacuum reduction furnace. A circulating water cooling system, control system and vacuum system were opened. A vacuum degree was controlled at a range of 30-50 Pa, and a heating rate was 10 K/min. When the temperature was raised to 1,500±100 K, the reduction reaction was conducted for 1 h, obtaining crystalline magnesium.

The XRD peaks of the crystalline magnesium prepared in this example were clear, and the crystallization was excellent. The purity was 89.82%, and the weight loss rate was 84.6%. Compared with the particle size of 300 meshes used in Example 1, it can be seen that a smaller particle size of the material means a more obvious reduction effect. This is because a smaller particle size means a larger contact area between carbon and dolomite and a stronger solid-solid reaction.

Example 3

According to the flowchart shown in FIG. 1: dolomite (MgO 19.35 wt %, CaO 27.48 wt %, Fe 3.69 wt %, Cu <0.005 wt %, $SiO_2$ 1.14 wt %, and $Al_2O_3$ 1.46 wt %) and coking coal were crushed and ground to 250 meshes. The dolomite was calculated by a $CaMg(CO_3)_2$ content, the coking coal was calculated by a C content, and the dolomite and the coking coal were compounded at a C:$CaMg(CO_3)_2$ molar ratio of 2, obtaining a mixed powder. After mixing well, the mixed powder was die cast at a pressure of 8 MPa, forming a bulk material. A vacuum reduction furnace was flushed with argon, and the bulk material was placed in the vacuum reduction furnace. A circulating water cooling system, control system and vacuum system were opened. A vacuum degree was controlled at a range of 30-50 Pa, and a heating rate was 10 K/min. When the temperature was raised to 1,500±100 K, the reduction reaction was conducted for 2 h, obtaining crystalline magnesium with a purity of 91.20%, and the weight loss rate was 87.8%.

Compared with the temperature hold for 1 h in Example 2, it can be seen that the longer holding time means a more obvious reduction effect. This is because the materials have more sufficient reaction time, and the crystallization time of the magnesium vapor is prolonged, with more sufficient nucleation and growth and higher purity.

Figure 2:
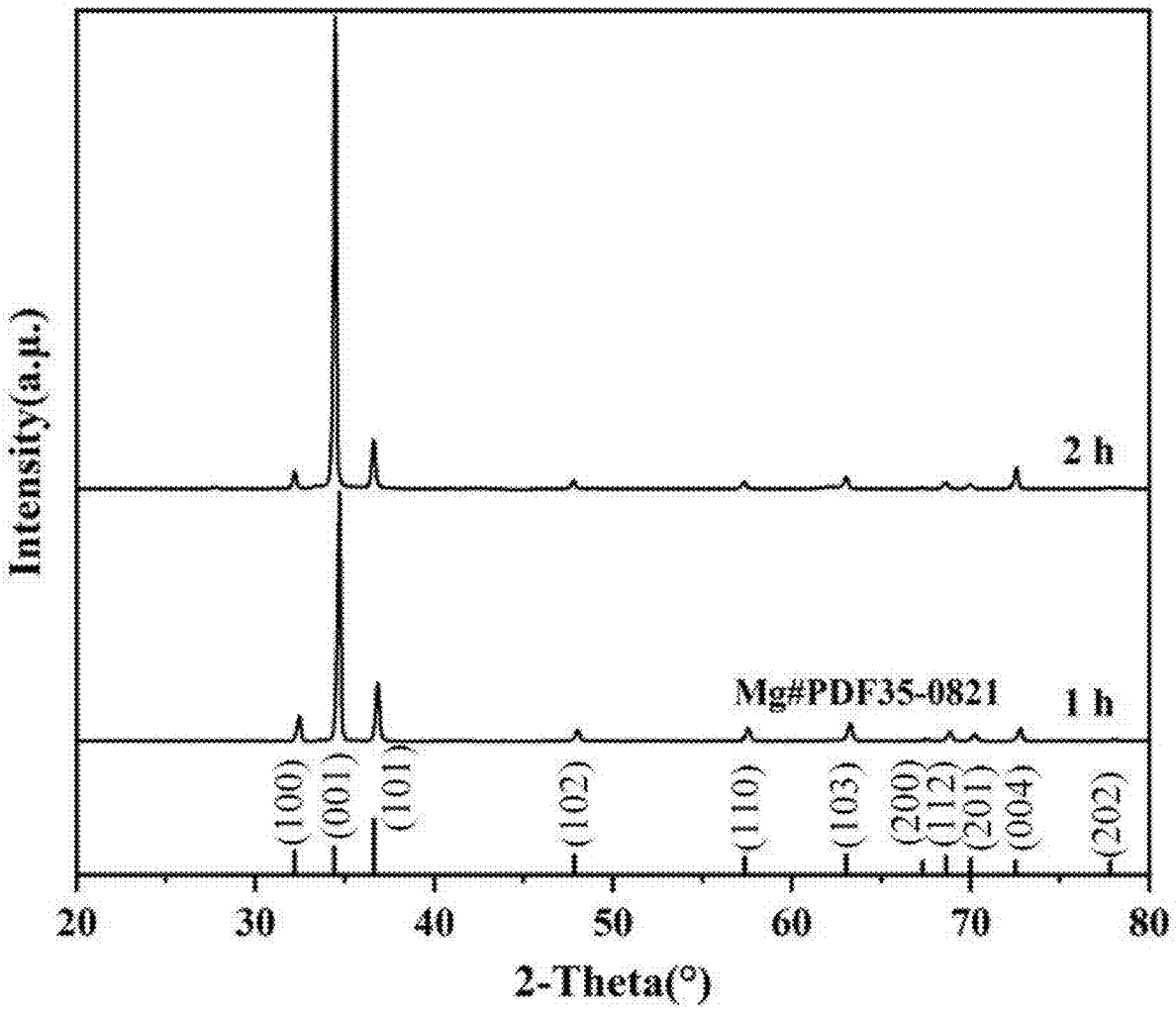
FIG. 2 shows an X-ray diffraction (XRD) pattern of the crystalline magnesium prepared in Examples 2 and 3 according to the present disclosure.
Figure 3:
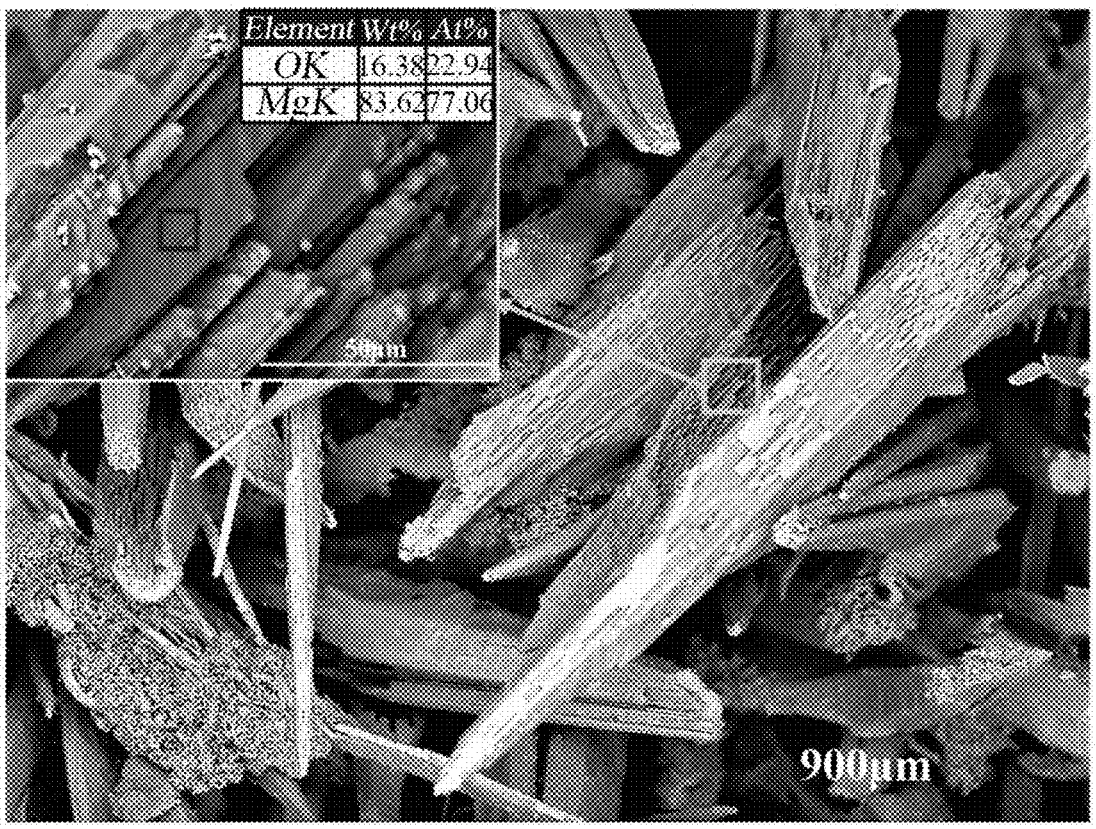
FIG. 3 shows a scanning electron spectrometer (SEM) image and an energy dispersive spectrum (EDS) image of the crystalline magnesium prepared in Example 1 according to the present disclosure.
Figure 4:
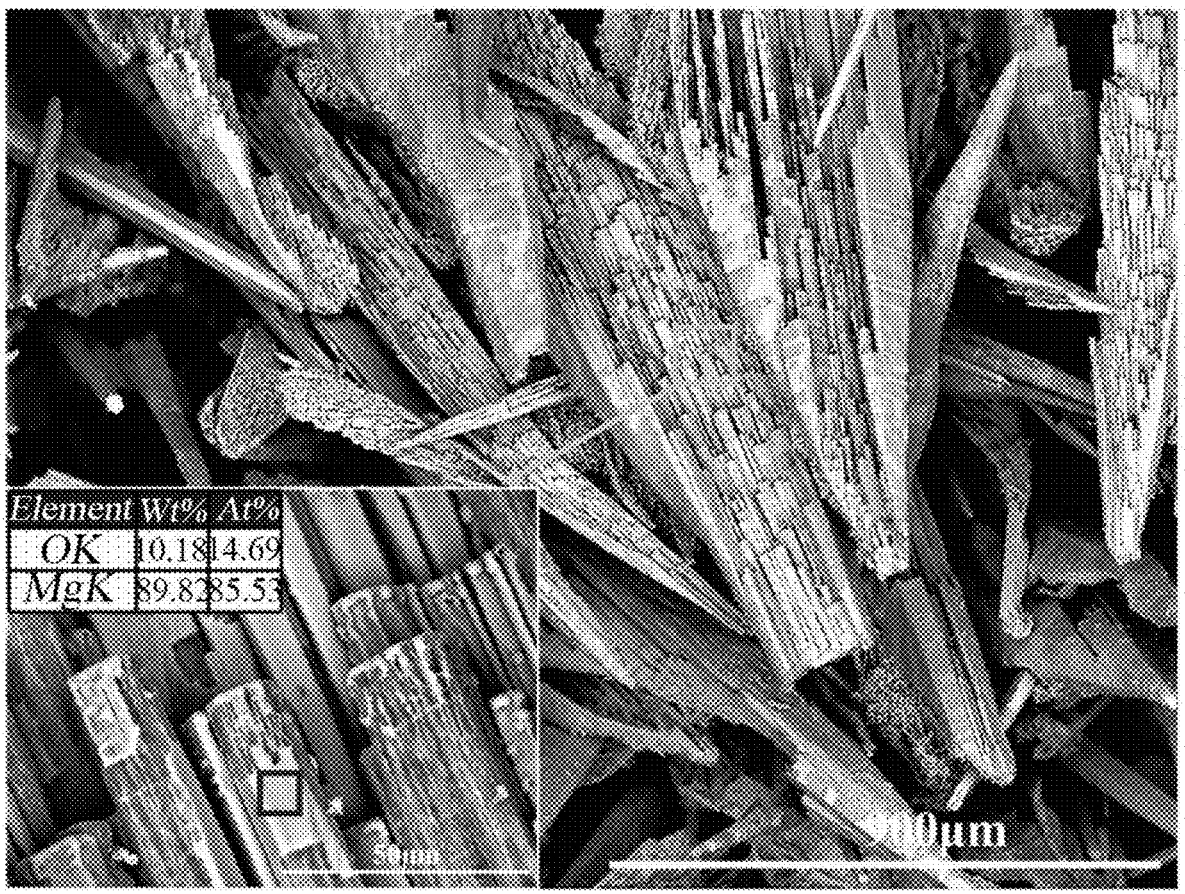
FIG. 4 shows an SEM image and an EDS image of the crystalline magnesium prepared in Example 2 according to the present disclosure.
Figure 5:
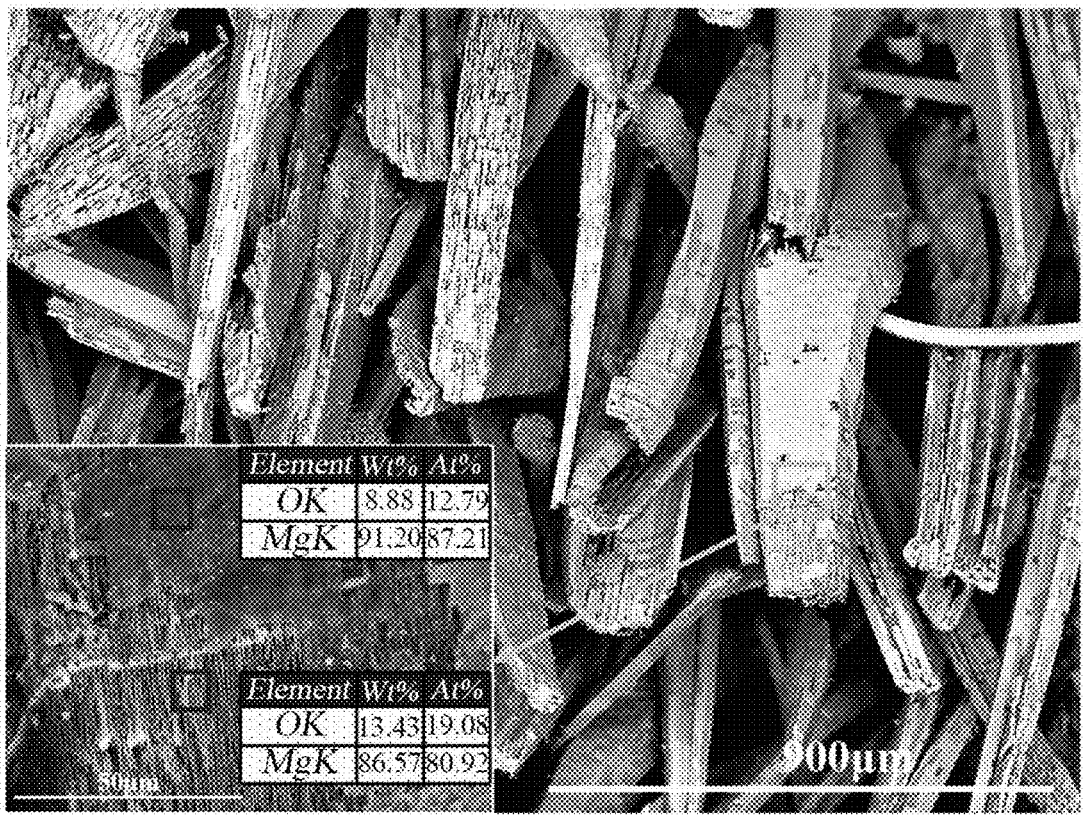
FIG. 5 shows an SEM image and an EDS image of the crystalline magnesium prepared in Example 3 according to the present disclosure.

The condensates prepared in Examples 1, 2 and 3 were detected on the XRD, SEM and EDS. The detection results are shown in FIGS. 2 to 5. Among them, FIG. 2 shows an XRD pattern of the crystal magnesium prepared in Examples 2 and 3 according to the present disclosure; FIG. 3 shows an SEM image and an EDS image of the crystalline magnesium prepared in Example 1 according to the present disclosure; FIG. 4 shows an SEM image and an EDS image of the crystalline magnesium prepared in Example 2 according to the present disclosure; and FIG. 5 shows an SEM image and an EDS image of the crystalline magnesium prepared in Example 3 according to the present disclosure. From FIGS. 2 to 5, it can be seen that the condensates are crystalline magnesium, after the dolomite has been reduced through carbothermal reduction. The XRD peaks of crystalline magnesium are clear, the crystallization is excellent, and all of the purities are above 83.62%.

Although the present disclosure has been described in detail by the above examples, but those examples are only a part, not all of the examples of the present disclosure. It should be understood that other examples can be obtained without creativity according to these examples, all of which are within the scope of the present disclosure.

What is claimed is:

1. A method for smelting magnesium from dolomite by vacuum carbothermal reduction, comprising:

pressing a mixed powder of dolomite and coking coal to obtain a block, wherein the dolomite comprises the following chemical compositions: 19.35 wt % of MgO, 27.48 wt % of CaO, 3.69 wt % of Fe, less than 0.005 wt % of Cu, 1.14 wt % of $SiO_2$, and 1.46 wt % of $Al_2O_3$; and heating the block directly to obtain a heated block, subjecting the heated block to a carbothermal reduction reaction in vacuum to obtain a reduced vapor, and condensing the reduced vapor to obtain crystalline magnesium, wherein the heating is conducted at a heating rate of ≤12 K/min; and the carbothermal reduction reaction is held at a temperature of ≥1,400 K for ≤2 h.

2. The method of claim 1, wherein the heating is conducted at a heating rate of 8-12 K/min.

3. The method of claim 1, wherein the carbothermal reduction reaction is held at a temperature of 1,400-1,600 K for 1-2 h.

4. The method of claim 1, wherein the pressing is conducted at a pressure of 6-16 MPa.

5. The method of claim 1, wherein in the mixed powder of dolomite and coking coal, a molar ratio of the coking coal in terms of C content to the dolomite in terms of a $CaMg(CO_3)_2$ content is 2:1.

6. The method of claim 1, wherein the mixed powder of dolomite and coking coal is prepared by a process comprising:

mixing the dolomite and the coking coal to obtain a mixture, and subjecting the mixture to crushing and grinding in sequence to obtain the mixed powder of dolomite and coking coal.

7. The method of claim 1, wherein the mixed powder of dolomite and coking coal has a particle size of ≤8.5 μm.

8. The method of claim 1, wherein the carbothermal reduction reaction is performed at a vacuum degree of 50-150 Pa.

9. The method of claim 1, wherein the condensing is conducted at a temperature of 623-760 K.

10. The method of claim 1, wherein the coking coal has a moisture content of <0.2%, an ash content of 26.21%, a volatile matter content of 10.17%, and a fixed carbon content of ≥63.42 wt %.

11. The method of claim 1, wherein the carbothermal reduction reaction is conducted in a vacuum furnace; the vacuum furnace is divided into a reaction chamber and a condensation chamber; the condensation chamber is arranged above the reaction chamber and connected with the reaction chamber by a connecting pipe; the block is subjected to the carbothermal vacuum reduction reaction in the reaction chamber of the vacuum furnace, and the reduced vapor is condensed in the condensation chamber through the connecting pipe to obtain the crystalline magnesium.

12. The method of claim 2, wherein the carbothermal reduction reaction is held at a temperature of 1,400-1,600 K for 1-2 h.

13. The method of claim 5, wherein the mixed powder of dolomite and coking coal is prepared by a process comprising:

mixing the dolomite and the coking coal to obtain a mixture, and subjecting the mixture to crushing and grinding in sequence to obtain the mixed powder of dolomite and coking coal.

14. The method of claim 5, wherein the mixed powder of dolomite and coking coal has a particle size of ≤8.5 μm.

15. The method of claim 8, wherein the carbothermal reduction reaction is conducted in a vacuum furnace; the vacuum furnace is divided into a reaction chamber and a condensation chamber; the condensation chamber is arranged above the reaction chamber and connected with the reaction chamber by a connecting pipe; the block is subjected to the carbothermal vacuum reduction reaction in the reaction chamber of the vacuum furnace, and the reduced vapor is condensed in the condensation chamber through the connecting pipe to obtain the crystalline magnesium.

* * * * *